US005412832A

United States Patent [19]

Irven

[11] Patent Number: 5,412,832

[45] Date of Patent: May 9, 1995

[54] EDGING PAINT ROLLER

[76] Inventor: Neil Irven, R.R. #4, Crysler Ontario, Canada, K0A 1R0

[21] Appl. No.: 223,729

[22] Filed: Apr. 6, 1994

[51] Int. Cl.[6] ..... B05C 17/02

[52] U.S. Cl. ..... 15/230.11; 492/13; 492/19

[58] Field of Search ..... 15/230.11; 492/13, 14, 492/19

[56] References Cited

U.S. PATENT DOCUMENTS

| | | | |
|---|---|---|---|
| 2,329,438 | 9/1943 | Fiedler, Jr. | 492/19 |
| 2,765,486 | 10/1953 | Anderson | 15/230 |
| 2,836,840 | 6/1958 | Pratt | 15/230.11 |
| 2,936,474 | 1/1958 | Custer | 15/230 |
| 3,023,443 | 9/1959 | Brandeis | 15/230 |
| 3,159,905 | 12/1964 | Baggett, Jr. | 492/19 |
| 3,205,526 | 7/1963 | Archibald | 15/230.11 |
| 3,273,192 | 9/1966 | Mazzella | 15/230.11 |
| 3,408,676 | 2/1967 | Cayo | 15/230.11 |
| 4,224,726 | 9/1980 | Walker | 492/13 |

FOREIGN PATENT DOCUMENTS

| | | | |
|---|---|---|---|
| 8301130 | 10/1984 | Netherlands | 15/230.11 |

*Primary Examiner*—David A. Scherbel

*Assistant Examiner*—Randall E. Chin

*Attorney, Agent, or Firm*—R. A. Wilkes

[57] ABSTRACT

The present invention relates to a paint roller capable of applying paint to inner corners, edges, and along or adjacent straight lines while still being appropriate for large area surface painting. The roller has an angled end face which spaces the end away from adjacent surfaces, while the contact surface of the roller applying paint can reach up to the inner corner. The construction includes an axle having a straight portion and an angled portion attached to one end by a fixed offset link. The straight portion carries a cylindrical roller body, while the angled portion carries a frusto-conical roller body of a size to extend the substantially linear contact surface of the cylindrical roller. The cylindrical roller has an open end partially containing the frusto-conical roller. Both roller bodies are encased by a tubular covering having pile fibres for carrying paint. The covering is elastic at least in the direction parallel to the straight portion of the axle. Therefore, as the frusto-conical roller rotates it will displace the tubular covering in the longitudinal direction. A handle is provided on the straight portion of the axle having an angular locking means for adjustment.

11 Claims, 1 Drawing Sheet

EDGING PAINT ROLLER

FIELD OF THE INVENTION

The present invention relates to a paint roller, particularly a paint roller capable of applying paint to inner corners, edges, and along or adjacent straight lines while still being appropriate for painting large area surfaces.

BACKGROUND OF THE INVENTION

Paint rollers have been used since the late 1940's for applying paint to a relatively large area. The conventional paint roller is not used in tight areas, nor close to edges and inner corners, as it cannot apply paint in a good straight line, and the structure of the rollers prevent them from being used close to tight areas. Often the end of the known cylindrical paint roller becomes covered with wet paint, so that when the roller is used close to an inner corner with an adjacent surface, such as a ceiling or floor, paint from the end of the roller is transferred to the adjacent surface. Additionally, devices used to retain the roller on its shaft often mar the adjacent surface. Various shields and guides have been proposed to keep the end of the roller both clean and spaced from the adjacent surface. Spacers, however, prevent the roller from applying paint up to an edge, or into a corner.

A brush or other small tool is necessary to cover such areas in order to finish a painting job. This system has several disadvantages. The painted surface often shows a different texture where different implements have been used; multiple painting tools must be cleaned; and covering these small areas can be extremely time consuming.

A number of painting tools have been proposed for applying paint into corners, up to edges, and in other tight areas. U.S. Pat. No. 2,765,486 describes a conical shaped paint roller having an angled end, so that only the contact portion of the roller reaches to the edge. Unfortunately a conic shape does not easily roll along a straight line, thus making both loading the roller, and applying paint with it, quite difficult. A loose bearing and an internal roller are provided to attempt to compensate. However, the result is an unwieldy loose roller, which still does not easily roll in a straight line.

U.S. Pat. No. 3,023,443 also describes a cone shaped roller for painting edges. The angle of the cone does serve to space the end of the roller from the adjacent surface in a corner, however in order to roll straight, the roller is mounted on a series of wheels which actually prevent the contact edge from applying paint right into a corner angle. Multiple tools are still required to complete a painting job.

Both of these patents incorporate an extreme conical shape which would likely result in an inconsistent amount of paint being available for distribution due to the extreme diameter change.

Bevelled rollers are proposed in U.S. Pat. No. 3,205,526 and in U.S. Pat. No. 2,936,474 for applying a small amount of paint up to the edges or into corners. These are similar to the conical rollers, and only the contact surface reaches to the edge. However, these devices seem only suitable for painting a very small area. Indeed these devices seem to be used to fill in the areas the conventional roller cannot reach.

SUMMARY OF THE INVENTION

The present invention seeks to provide a paint roller suitable for applying paint to a relatively large surface, and to apply paint in a straight line with a consistent texture over the whole painted surface. The invention also seeks to provide a paint roller which is able to apply paint into a restricted corner, or up to an edge, without marring adjacent surfaces, or applying unwanted paint to them. Further the invention seeks to provide a painting tool capable of painting up to an edge or a corner wherein only a part of the rim of the paint carrying surface reaches to the edge or corner, and the rest of the tool, particularly the end face of the roller, is spaced from the adjacent: surface.

Accordingly, the present invention provides a paint roller comprising an axle including a first straight portion and a second portion angled relative to the first straight portion attached with an offset to an end of the straight portion; a cylindrical roller body rotatably mounted on the first straight portion of the axle having an open end and extending over a major proportion of the length of the axle, and having a substantially linear painting contact surface; a frusto-conical roller body having a narrower end and a wider end, rotatably mounted on the second angled portion of the axle, having a substantially linear painting contact surface, and having its narrower end partially contained within the open end of the cylindrical roller body; and a tubular covering constructed and adapted to carry paint, which is elastic in at least a direction substantially parallel to the first straight portion of the axle encasing both the cylindrical roller body and the frusto-conical roller body; wherein the linear painting contact surface of the frusto-conical roller body provides an extension to the linear painting contact surface of the cylindrical roller body.

In a preferred embodiment the relationship between the two portions of the axle is determined by the included angle of the cone, which is equal to twice the angle between the shafts, with the big end diameter of the cone chosen so that a common face with the first roller is obtained. The smaller end of the frusto-conical roller can be positioned partially within the open end of the first roller, giving what appears to be a single roller with an angled end face sufficient to provide clearance from adjacent surfaces.

If such a roller with an angled end were made in one piece, no advantage would be obtained, because when rolled in a straight line it would leave a sinuous line at the angled end. The roller of this invention does not do that: the angled end of the second frusto-conical roller rotates on its separate axis simultaneously with the first cylindrical roller, thus leaving a straight line of paint at both ends of the roller.

In order to do this, the roller carries a tubular covering to transfer paint which is elastic at least in a direction substantially parallel to the axis of the cylindrical roller. Hence, as the two rollers rotate together, and the effective length of the roller on any given axial line changes as it rotates, the paint carrying cover stretches to accommodate the change in length. Further, when painting into a corner, or up to an edge, it is only a small part of the second roller's outside rim which comes close to the adjacent surface of the corner: the end face of the roller is set away by the angle between the two shafts. Any retaining means used to hold the second roller onto the second shaft or to secure the covering is recessed into the end face. Hence due to the rotating angled end face, the adjacent surface is not touched, and unwanted paint is not applied to it. A small angle is chosen to provide sufficient clearance from adjacent surfaces which may, for example, include stippling or other surface textures. The actual angle is determined by a balance of the diameter of the cylindrical roller and the acceptable stretch displacement of the fabric covering. It is contemplated that the preferred small angle will be between 10 and 30 degrees, particularly about 15 degrees. In order to create an end face with a continuous appearance, the larger diameter of the frusto-conical roller is slightly larger than the diameter of the cylindrical roller. This design may also relieve surface tension during extension and retraction, attempting to more evenly distribute the stretch of the fabric.

In order to simplify manufacture it is proposed to construct the axle from a single rod which is bent to form the appropriate offset and angle.

This arrangement makes it possible to apply paint accurately to straight edges and restricted areas with a large general purpose tool with the added advantage of consistent product texture.

In a preferred embodiment the paint roller is provided with an adjustable handle so that the angle between the handle and the contact surface can be adjusted for different applications, to accommodate right and left handed use and for individual comfort.

BRIEF DESCRIPTION OF THE DRAWINGS

A preferred embodiment of the invention will be described in detail with reference to the following drawings in which.

DETAILED DESCRIPTION

Figure 1:
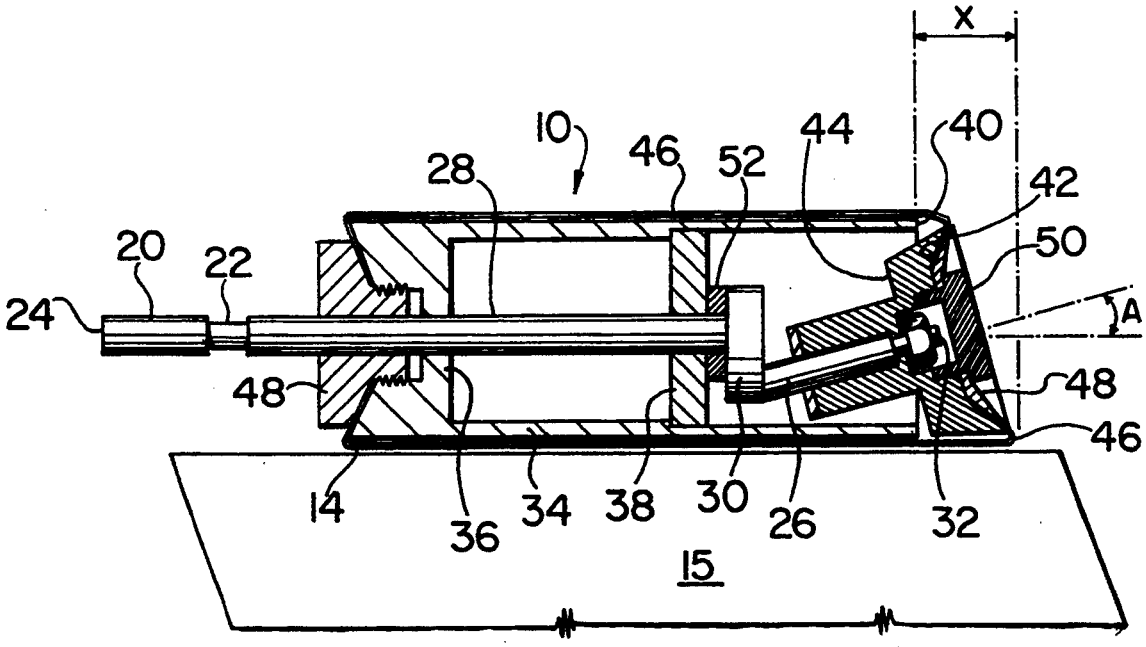
FIG. 1 illustrates the roller without its handle in longitudinal cross-section.

With reference to FIG. 1 a roller according to the present invention is shown generally at 10. The roller 10 is provided with an axle 20 having a handle notch 22 adjacent its free end 24. The axle also has a first substantially straight portion 28, an offset link 30, and a second angled portion 26 fixed to the offset link 30, having an outside end 32. The roller 10 further includes an elongated cylindrical roller body 34 rotatably mounted on the first substantially straight portion 28 of the axle 20. The cylindrical roller body 34 is preferably hollow having a first roller support 36 with rotatable bearings supporting the cylindrical roller body 34 adjacent the free end 24 of the axle 20 and a second roller support 38 with rotatable bearings supporting the cylindrical roller body 34 adjacent the offset 30. Preferably, an open end 40 of the cylindrical roller body 34 projects beyond the offset 30, substantially containing the second axle shaft 26. The bearing 38 is shaped to support the projecting open end 40 of the cylindrical roller body 34. A frusto-conical roller body 42 is rotatably mounted on the second angled portion 26 of the axle 20 partially within the open end 40 of the cylindrical roller body 34. The smaller diameter end 44 of the frusto-conical roller body 42 is oriented toward the inside of the cylindrical roller body 34. The angle A of the second angled portion 26 of the axle 20 corresponds to half the included angle of the cone such that the contact surface of the frusto-conical roller 42 provides an extension to the contact surface of the cylindrical roller body 34. In other words, there is a single co-extensive line of contact 14 of the fabric 46 with the surface shown schematically at 15 to which paint is applied.

The cylindrical roller body 34 and the frusto-conical roller body 42 are encased in a tubular covering 46 of elastic, highly absorbent, paint compatible fabric, which may include highly concentrated pile fibres on the outside surface. Suitable fibres which are conventional for this purpose include nylon, polyester and wool. The elasticity of the covering in a longitudinal direction is sufficient to accommodate the displacement X caused by rotation of the frusto-conical roller body 42. The covering 46 is maintained in place by recessed cover plates 48 at either end of the roller 10 which are preferably threaded to the roller bodies 34 and 42 so that the covering may be removable and replaceable. Alternatively, a recessed threaded cap such as 50 may be used to retain the cover plate 48. If desired, a bearing is provided as at 52 between the roller support 38 and the offset 30.

Figure 2:
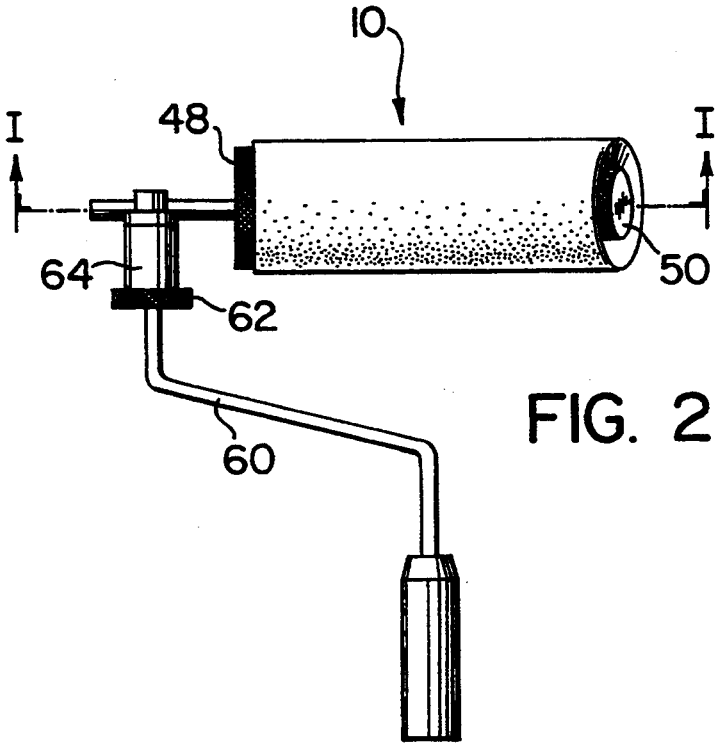
FIG. 2 illustrates a paint rolling implement incorporating the roller of the present invention in plan view.

Referring now to FIG. 2, the roller 10 is provided with an adjustable handle 60, which can be angularly set by a locking means 62 such that the handle 60 can be set to an appropriate angle from the plane of the contact surface 14. Depending on the area to be painted, or whether the user is right or left handed, a comfortable angle is selected by the user. The angle may change if the surface to be painted is a horizontal floor or a vertical wall, for example. Loosening of the locking means 62 also disengages the sub-handle 64 from the notch 22 in the shaft 20, thus permitting complete dismantling of the roller, for example for cleaning.

The embodiments of the present invention in which an exclusive property or privilege is claimed are defined as follows:

1. A paint roller comprising:

an axle including a first straight portion, a second portion angled relative to the first straight portion, and an offset link connecting said first and second portions;

a cylindrical roller body rotatably mounted on the first straight portion of the axle having an open end and extending over a major portion of the length of the axle, and having a substantially linear painting contact surface;

a frusto-conical roller body having a narrower end and a wider end, rotatably mounted on the second portion of the axle, having a substantially linear painting contact surface, and having its narrower end partially contained within the open end of the cylindrical roller body; and a tubular covering constructed and adapted to carry paint, which is elastic in at least a direction substantially parallel to the first straight portion of the axle encasing both the cylindrical roller body and the frusto-conical roller body; wherein the linear painting contact surface of the frusto-conical roller body provides an extension to the linear painting contact surface of the cylindrical roller body.

2. A paint roller as claimed in claim 1 wherein the angle of the second portion of the axle relative to the first straight portion is equal to one half the included cone angle of the frusto-conical roller.

3. A paint roller as claimed in claim 2 wherein the angle of the second portion of the axle relative to the first straight portion is from about 10 to about 30 degrees.

4. A paint roller as claimed in claim 2 wherein the angle of the second portion of the axle relative to the first straight portion is about 15 degrees.

5. A paint roller as claimed in claim 1 wherein the first straight portion and the second portion are formed from a single rod bent to form the angle.

6. A paint roller as claimed in claim 1 wherein the tubular covering is removable.

7. A paint roller as claimed in claim 6 wherein the tubular covering is removably secured by securing means.

8. A paint roller as claimed in claim 7 wherein the securing means each are recessed within end faces of the roller.

9. A paint roller as claimed in claim 1 wherein the cylindrical roller body is substantially hollow and is mounted on the first straight portion by rotatable bearing means.

10. A paint roller tool comprising:

an axle including a first straight portion, a second portion angled relative to the first straight portion, and an offset link connecting said first and second portions attached with an offset to an end of the straight portion;

a cylindrical roller body rotatably mounted on the first straight portion of the axle having an open end and extending over a major portion of the length of the axle, and having a substantially linear painting contact surface;

a frusto-conical roller body having a narrower end and a wider end, rotatably mounted on the second portion of the axle, having a substantially linear painting contact surface, and having its narrower end partially contained within the open end of the cylindrical roller body; and a tubular covering constructed and adapted to carry paint, which is elastic in at least a direction substantially parallel to the first straight portion of the axle encasing both the cylindrical roller body and the frusto-conical roller body; wherein the linear painting contact surface of the frusto-conical roller body provides an extension to the linear painting contact surface of the cylindrical roller body; and an adjustable handle attached to an end of the axle.

11. A paint roller tool as claimed in claim 10 wherein the adjustable handle includes an angular locking means.

* * * * *